US006010304A

United States Patent [19]

Moniz et al.

[11] Patent Number: 6,010,304

[45] Date of Patent: Jan. 4, 2000

[54] BLADE RETENTION SYSTEM FOR A VARIABLE ROTOR BLADE

[75] Inventors: Thomas Moniz, Loveland; Peter A. Jensen, West Chester; August H. Kramer, Cincinnati, all of Ohio

[73] Assignee: General Electric Company, Cincinnati, Ohio

[21] Appl. No.: 08/960,453

[22] Filed: Oct. 29, 1997

[51] Int. Cl.[7] ..... F01D 5/30

[52] U.S. Cl. ..... 416/155; 416/220 R; 416/205

[58] Field of Search ..... 416/153, 155, 416/167, 220 R, 168 R, 174, 205, 207, 208, 209, 221

[56] References Cited

U.S. PATENT DOCUMENTS 2,930,581 3/1960 Klint ..... 416/220

3,508,844 4/1970 Blanc ..... 416/221

5,015,150 5/1991 Rohra ..... 416/207

FOREIGN PATENT DOCUMENTS 1173073 8/1985 U.S.S.R. ..... 416/155

*Primary Examiner*—Edward K. Look

*Assistant Examiner*—Richard Woo

*Attorney, Agent, or Firm*—Andrew C. Hess; Rodney M. Young

[57] ABSTRACT

A blade retention system which allows a blade to be rotated about a blade stack axis by utilizing a cover, an anti-rotational key, and strap is described. The substantially cylindrical cover rotatably couples to a rotor disk opening using a thrust bearing. The cover includes a dovetail-load slot for receiving a rotor blade dovetail key. The anti-rotation key is positioned between the dovetail key and the dovetail-load slot to secured the blade to the cover. The strap holds the key in place and is clamped between the cover and the control mechanism.

14 Claims, 3 Drawing Sheets

BLADE RETENTION SYSTEM FOR A VARIABLE ROTOR BLADE

GOVERNMENT RIGHTS

The United States Government has rights in this invention pursuant to Contract No. N00024-94-C-4015 awarded by the Department of the Navy.

FIELD OF THE INVENTION

This invention relates generally to turbine engines and, more particularly, to retaining a variable rotor blade against high radial loads.

BACKGROUND OF THE INVENTION

Turbomachinery commonly employs blades, connected to a disk. For example, a typical compressor rotor assembly of a gas turbine engine includes a plurality of rotor blades extending radially outward across an airflow path. The blades generally include an airfoil section mounted radially outward of a blade root section. A platform is located between the airfoil section and the blade root section, and the platform forms a portion of the boundary between the rotor and the working medium. The blade is normally mounted in the rim of a rotor disk by its root interlockingly engaging a slot in the rim. Compressor blade roots are conventionally curvilinear in form and referred to as dovetail keys and the matching conforming slots are referred to as dovetail-load slots.

It would be desirable, to provide a blade retention system, for use in a gas turbine engine, which allows a blade to be rotated about a blade stack axis. It would also be desirable to provide such a system which allows the blade to be installed by extending the blade into the rotor disk while retaining the blade against high radial loads.

SUMMARY OF THE INVENTION

These and other objects may be attained by a blade retention system, which in one embodiment, rotatably couples a rotor blade to a rotor disk, in a gas turbine engine. The blade retention system includes a substantially cylindrical shaped cover having a dovetail-load slot for receiving a rotor blade dovetail key. The cover also includes a bearing seat located between a first portion and a second portion for extending into a rotor thrust bearing so that the cover rotates relative to the rotor disk. The cover further includes a cover flange that is coupled to a control mechanism located within the rotor disk. The system also includes an anti-rotational key sized to be in substantial surface to surface contact with a portion of a dovetail-load slot and the dovetail key so that the blade is secured to the cover. The system further includes a strap that is clamped between the cover flange and the control mechanism so that the antirotation key is secured between the cover and the dovetail key.

The rotatable rotors are coupled to the rotor disk by placing the system cover inside the rotor disk and extending the cover into the thrust bearing. From the outside of the rotor disk, the blade dovetail key is then extended into the cover dovetail-load slot. After rotating the rotor blade 90 degrees relative to the cover, the anti-rotation key is positioned between the dovetail key and the cover dovetail-load slot so that the blade is secured. The strap is then clamped between the control mechanism and the cover so that the anti-rotation key is secured. In operation, the actuation of the control mechanism rotates the cover so that the rotor blade is rotated about a blade stack axis.

The above-described blade retention system allows a blade to be rotated about the blade stack axis. In addition, the system allows the blade to be installed by extending the blade into a rotor disk while retaining the blade against high radial loads.

DETAILED DESCRIPTION

Figure 1:
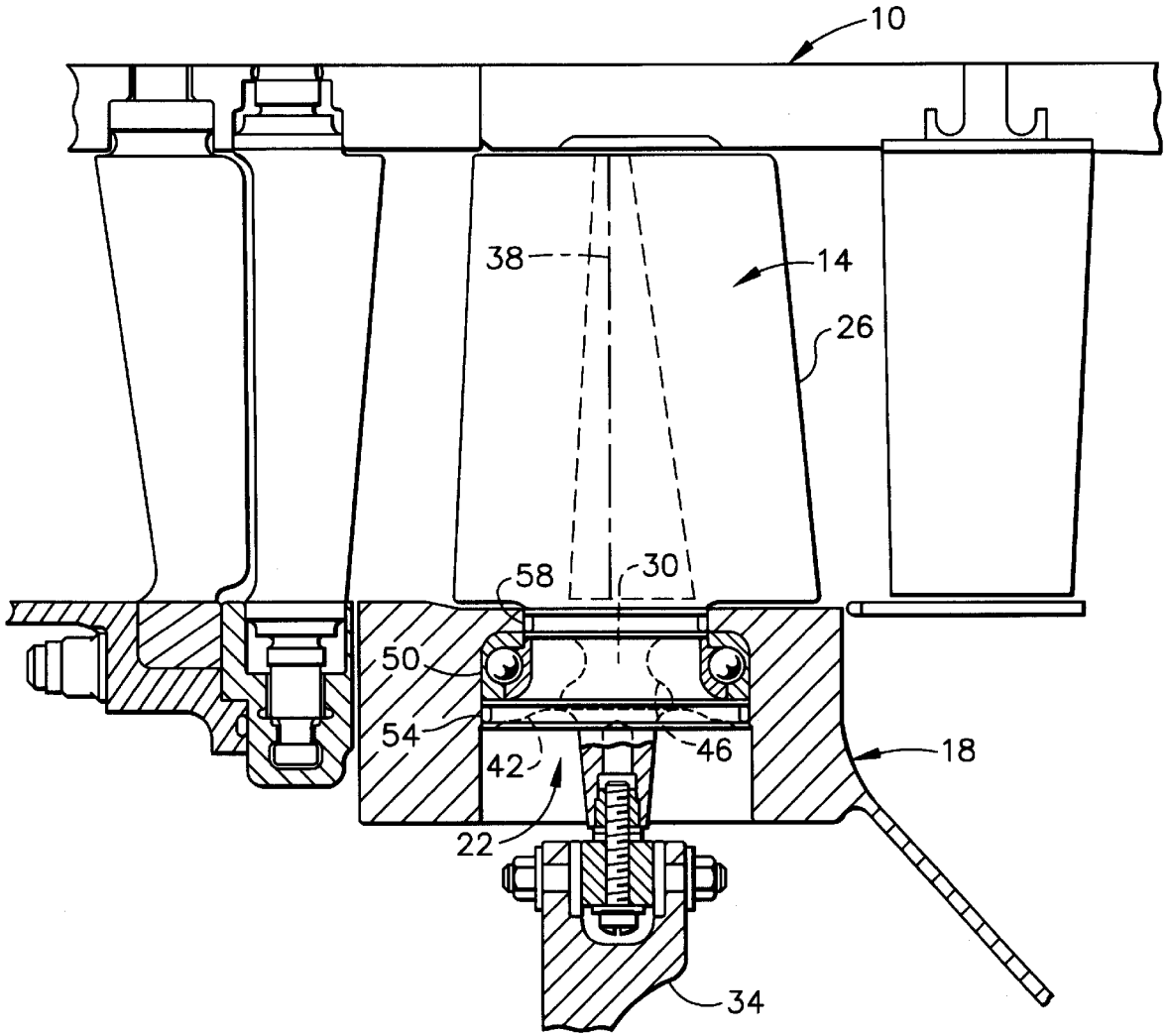
FIG. 1 is a side view, in cross section, of a gas turbine engine outer case.

FIG. 1 is a side view, in cross section, of a gas turbine engine outer case 10 containing a variable rotor blade 14 secured to a rotor disk 18 using a blade retention system 22. Variable rotor blade 14 includes a blade 26 and a dovetail key 30. Blade retention system 22 is coupled to a control mechanism 34 for rotating blade 14 about a blade stack axis 38. Blade retention system 22 includes a cover 42 having a dovetail load slot 46 sized to receive blade dovetail key 30. System 22 is rotatably coupled to disk 18 using a thrust bearing 50. Substantially circular ring gaskets 54 and 58 prevent contaminants from coming in contact with bearing 50.

Figure 2:
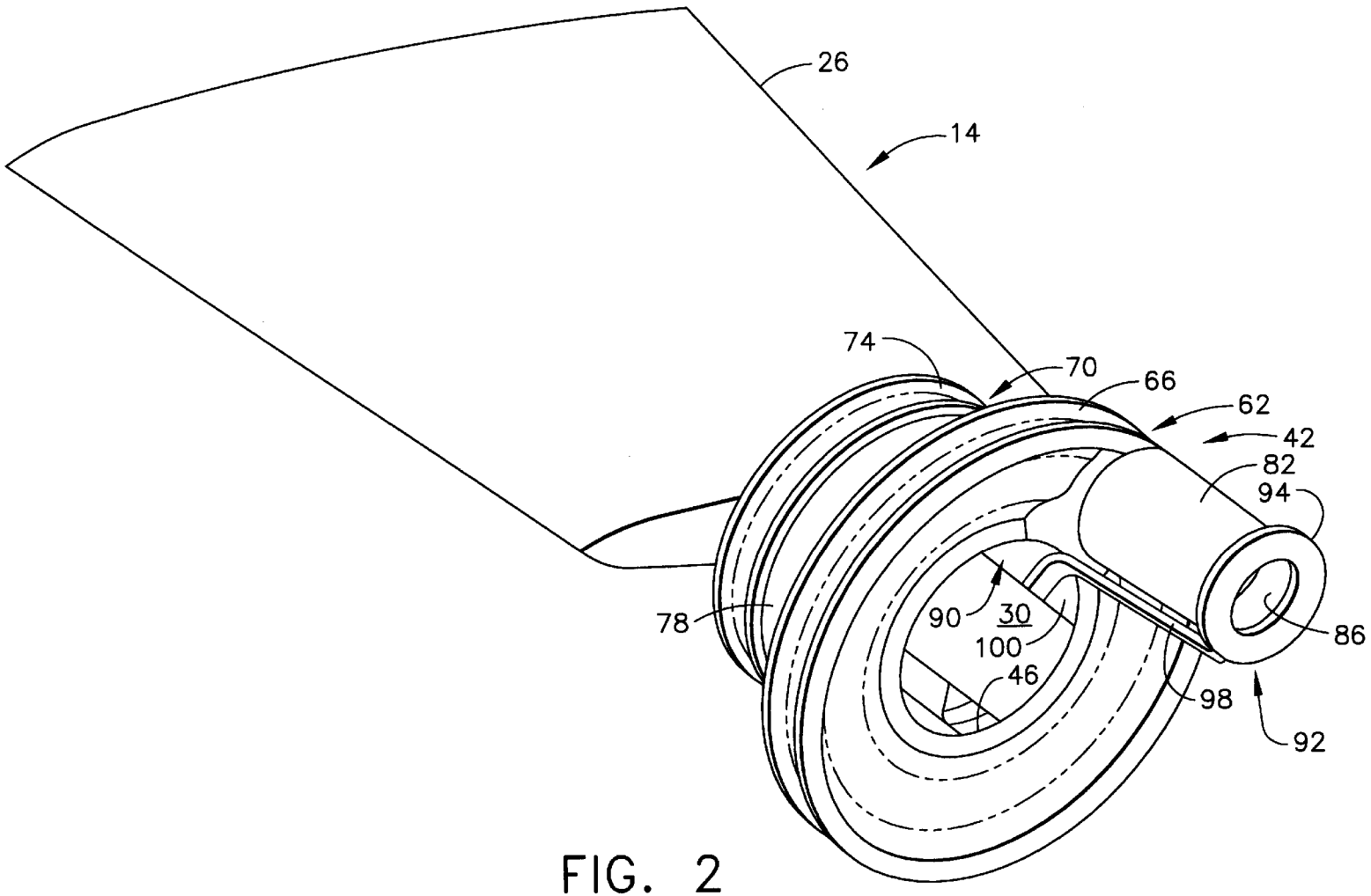
FIG. 2 is a perspective view of a variable rotor blade with a blade retention system in accordance with one embodiment of the present invention.

As shown in FIG. 2, blade 14 includes a substantially cylindrical shaped portion 70 having a gasket seat 74 sized to receive gasket 58. Cover 42 also includes a substantially cylindrical shaped portion 62 having a gasket seat 66 sized to receive gasket 54. A bearing seat 78 is located on cover 42 between cylindrical shaped portions 62 and 70 for extending into bearing 50. Cover 42 further includes a substantially cylindrical flange 82 extending from cover first portion 62. Flange 82 includes an axial bore 86 for coupling cover 42 to control mechanism 34.

System 22 also includes an anti-rotational key 90 sized to be in substantial surface to surface contact with a portion of dovetail load slot 46 and one side of dovetail key 30 so that blade 26 is secured to cover 42. Key 90 has a semi-circular cross-sectional shape. A strap 92 having a substantially ring shaped disk 94 and a substantially elongate l-shaped member 98 extend from a periphery of disk 94 to a top surface 100 of key 90. Member 98 is clamped between cover flange 82 and control mechanism 34 so that key 90 remains positioned between cover 42 and dovetail key 30.

Figure 3:
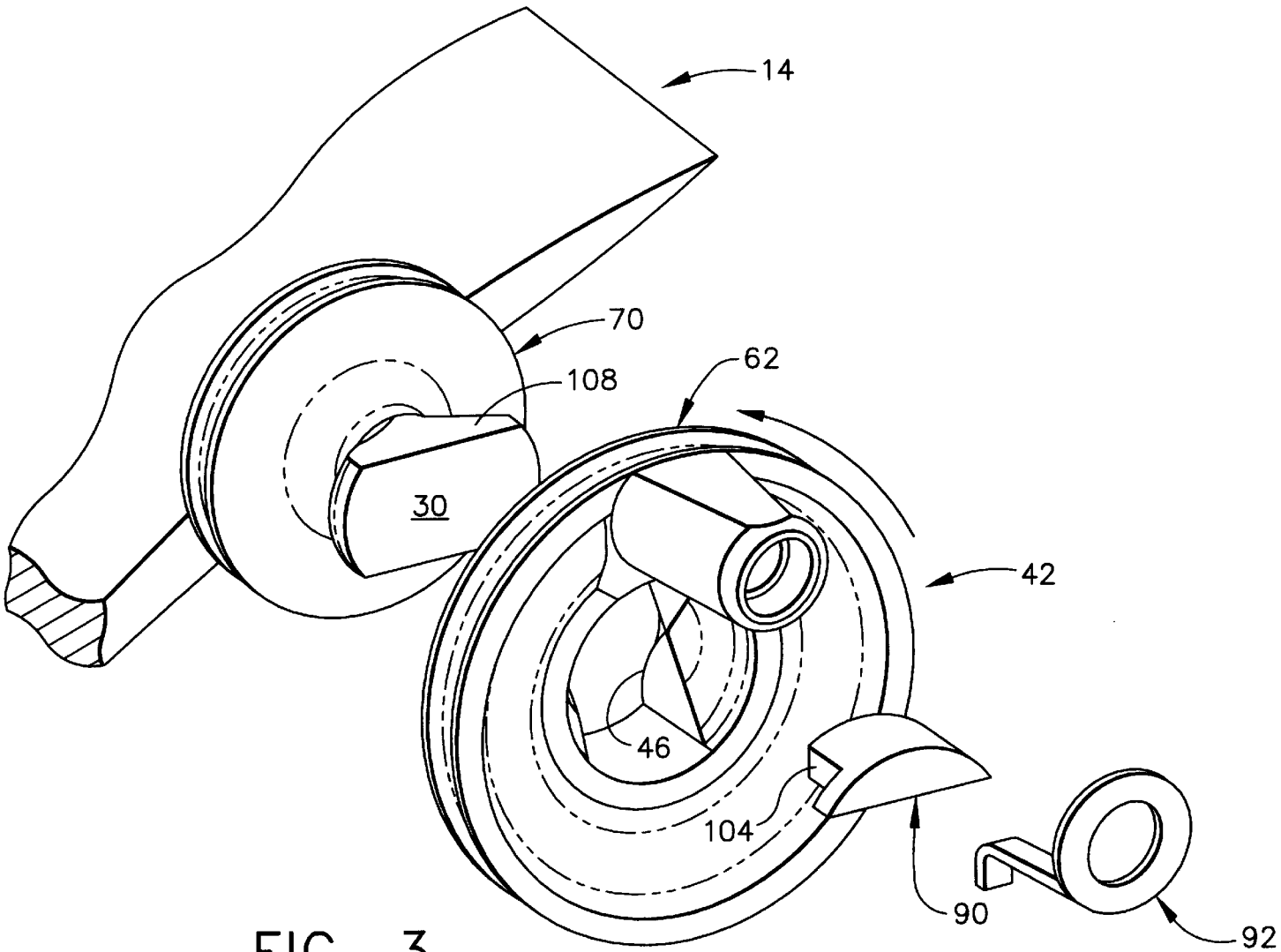
FIG. 3 is a perspective, partially exploded view of a blade retention system of FIG. 2 prior to coupling the rotor blade to the system.

As shown in FIG. 3, which is a partially exploded view of a blade retention system 22, key 90 includes a locking portion 104 sized to be positioned adjacent to a dovetail key side 108. Anti-rotational key 90 prevents dovetail key 30 from rotating relative to cover 42.

Prior to securing blade 14 to disk 18 using system 22, gaskets 54 and 58 are positioned on respective gaskets seats 66 and 74. Cover 42 is then extended into thrust bearing 50 until cover 42 is fully seated. Blade dovetail key 30 is then located in dovetail-load slot 46 and rotated 90 degrees so that dovetail key 30 fully extends into cover 42. Anti-rotational key 90 is then positioned within cover 42 so that key 90 is positioned against side 108 of dovetail key 30 and cover 42. After positioning strap disk 94 over flange bore 86, control mechanism 34 is extended into flange bore 86 and secured. In operation, actuation of control mechanism 34 causes the rotation of cover 42 so that blade 14 is rotated about stack axis 38.

The above-described blade retention system allows a blade to be rotated about a blade stack axis. In addition, the system allows the blade to be installed by extending the blade into a rotor disk while retaining the blade against high radial loads. Additionally, the system transmits the blade load through a blade dovetail key into a rotor disk thrust bearing.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

We claim:

1. A blade retention system for rotatably coupling a variable rotor blade to a rotor disk in a gas turbine engine, the blade having a dovetail key and a substantially cylindrical shaped portion, said system comprising:

a cover having a substantially cylindrical shaped portion, and a dovetail-load slot sized to receive the blade dovetail key, said cover further including a control flange;

a control mechanism located within the rotor disk for adjusting rotation of the blade about a blade stack axis, said control mechanism is directly coupled to said control flange;

an anti-rotation key sized to be in substantial surface to surface contact with a portion of said dovetail slot and the blade dovetail key; and a strap configured to secure said anti-rotation key to said cover.

2. A blade retention system in accordance with claim 1 wherein said cover flange includes an axial bore, and wherein a portion of the control mechanism is extended into said flange bore.

3. A blade retention system in accordance with claim 1 wherein the rotor disk includes a thrust bearing and said cover first substantially cylindrical shaped portion includes a gasket seat and a gasket, wherein said gasket is coupled to said gasket seat to prevent contamination from entering the bearing from an area inside the rotor disk.

4. A blade retention system in accordance with claim 3 wherein said blade substantially cylindrical shaped portion includes a gasket seat and a second gasket, wherein said second gasket is coupled to said second portion gasket seat to prevent contamination from entering the bearing from an area outside the rotor disk.

5. A blade retention system in accordance with claim 1 wherein said anti-rotation key has a semi-circular cross sectional shape.

6. A blade retention system in accordance with claim 1 wherein said strap includes a substantially elongate l-shaped member extending from a substantially ring shaped disk.

7. A variable rotor blade apparatus for use in a gas turbine engine, the engine having a rotor disk and a control mechanism, the rotor disk having a dovetail opening, said variable rotor blade apparatus comprising:

a rotor blade having a dovetail key and an airfoil, said dovetail key being complementary to and axially disposed to the dovetail opening; and a blade retention system for radially retaining said blade in the rotor disk said blade retention cover including a cover flange, configured to be directly coupled to the control mechanism.

8. A variable rotor blade apparatus in accordance with claim 7 wherein said blade retention includes a cover having a dovetail-load slot being complementary to and axially disposed to said rotor blade dovetail key.

9. A variable rotor blade apparatus in accordance with claim 8 wherein said blade retention includes an anti-rotational key sized to be in substantial surface to surface contact with a portion of said dovetail slot and the blade dovetail key.

10. A variable rotor blade apparatus in accordance with claim 8 wherein said blade retention includes a strap configured to secure said key to said cover.

11. A variable rotor blade apparatus in accordance with claim 8 wherein said cover flange includes an axial bore, and wherein a portion of the control mechanism is extended into said flange bore.

12. A variable rotor blade apparatus in accordance with claim 8 further comprising a rotor disk thrust bearing wherein said cover is rotatably coupled to said bearing.

13. A variable rotor blade apparatus in accordance with claim 12 wherein said cover includes a first substantially cylindrical shaped portion, a second substantially cylindrical shaped portion, and a bearing seat located between said first and second portions, and wherein said bearing seat is rotatably coupled to said bearing.

14. A variable rotor blade apparatus in accordance with claim 13 wherein said first and second portions each include a gasket seat and a gasket, wherein said gaskets are coupled to said first and second portion gasket seats and interface with the rotor disk to prevent contamination from entering the bearing.

* * * * *